US008789731B2

(12) United States Patent
Hart

(10) Patent No.: US 8,789,731 B2
(45) Date of Patent: Jul. 29, 2014

(54) APPARATUS AND METHOD FOR STORING AND TRANSPORTING ELECTRONIC DEVICES

(76) Inventor: Robert D. Hart, Roseville, CA (US)

( * ) Notice: Subject to any disclaimer, the term of this patent is extended or adjusted under 35 U.S.C. 154(b) by 557 days.

(21) Appl. No.: 13/107,690

(22) Filed: May 13, 2011

(65) Prior Publication Data

US 2011/0284607 A1 Nov. 24, 2011

Related U.S. Application Data

(60) Provisional application No. 61/396,260, filed on May 24, 2010, provisional application No. 61/402,270, filed on Aug. 26, 2010, provisional application No. 61/465,555, filed on Mar. 19, 2011.

(51) Int. Cl.

| | |
|---|---|
| ***A45F 3/14*** | (2006.01) |
| ***A45F 3/04*** | (2006.01) |
| ***A45F 3/08*** | (2006.01) |
| ***A45F 3/10*** | (2006.01) |
| *A45F 3/02* | (2006.01) |
| *A45C 13/02* | (2006.01) |

(52) U.S. Cl.

CPC . *A45C 13/02* (2013.01); *A45F 3/04* (2013.01); *A45C 2200/15* (2013.01); *A45F 3/02* (2013.01); *A45C 2013/025* (2013.01); *Y10S 224/93* (2013.01)

USPC ..... 224/257; 224/259; 224/197; 224/930

(58) Field of Classification Search

USPC ..... 224/257, 258, 260, 261, 265, 930; 206/320; 455/575.6, 575.8, 575.9; 379/446, 449, 450, 454, 455; D3/218; D14/250, 251, 252, 253, 447; 361/679.59, 679.03

See application file for complete search history.

(56) References Cited

U.S. PATENT DOCUMENTS

| | | | | | |
|---|---|---|---|---|---|
| 4,921,103 | A | * | 5/1990 | Cohen | 206/523 |
| 5,654,846 | A | * | 8/1997 | Wicks et al. | 360/99.15 |
| 5,724,225 | A | * | 3/1998 | Hrusoff et al. | 361/679.55 |
| 5,775,497 | A | * | 7/1998 | Krulik | 206/320 |
| 5,808,865 | A | * | 9/1998 | Alves | 361/679.31 |
| D426,955 | S | * | 6/2000 | Salvatori et al. | D3/301 |
| 6,145,661 | A | * | 11/2000 | Jung | 206/320 |
| 6,164,505 | A | | 12/2000 | Holter et al. | |
| 6,659,319 | B2 | | 12/2003 | Purpura | |
| 6,977,809 | B2 | * | 12/2005 | Bovino | 361/679.55 |
| D517,321 | S | * | 3/2006 | Wilde et al. | D3/321 |
| 7,293,649 | B2 | * | 11/2007 | Gelphman et al. | 206/320 |
| 7,320,402 | B2 | * | 1/2008 | Lewis | 206/320 |

(Continued)

*Primary Examiner* — Justin Larson
*Assistant Examiner* — Lester L Vanterpool
(74) *Attorney, Agent, or Firm* — R. Michael West

(57) ABSTRACT

Apparatus and methods for storing and transporting electronic devices. A housing includes a base, opposing sides, a movable cover, and an open lower end. The base has a cutout portion at the lower end. The movable cover is generally coextensive with and parallel to the base, and is resiliently biased into a normally closed position. The cover includes an access aperture at the lower end. Stop means are also provided at the lower end, partially blocking the opening and preventing a stored device from falling out of the housing's lower end. The cutout portion and the aperture allow entry of the user's hand into the housing for either insertion or withdrawal of the device. During either process, the user's hand causes the cover temporarily to be raised into an open position. A sling, a backpack harness, or a handle may be selectively attached to the housing for transport or storage.

19 Claims, 5 Drawing Sheets

(56) References Cited

U.S. PATENT DOCUMENTS

| | | | | |
|---|---|---|---|---|
| 7,469,809 | B2 * | 12/2008 | Rodarte et al. | 224/578 |
| 7,487,896 | B2 * | 2/2009 | Howard et al. | 224/576 |
| 7,735,644 | B2 * | 6/2010 | Sirichai et al. | 206/320 |
| 7,778,026 | B2 * | 8/2010 | Mitchell | 361/679.55 |
| 8,104,655 | B2 * | 1/2012 | Zhang | 224/623 |
| 8,235,208 | B2 * | 8/2012 | Sirichai et al. | 206/320 |
| 8,256,619 | B2 * | 9/2012 | Lebauer et al. | 206/579 |
| 2002/0088726 | A1 * | 7/2002 | Chou | 206/320 |
| 2004/0144821 | A1 * | 7/2004 | Gelphman | 224/610 |
| 2004/0262358 | A1 | 12/2004 | Meyer | |
| 2006/0037987 | A1 | 2/2006 | Lin | |
| 2007/0215663 | A1 * | 9/2007 | Chongson et al. | 224/930 |
| 2009/0107878 | A1 * | 4/2009 | Daley, III | 206/576 |
| 2009/0250494 | A1 * | 10/2009 | Studer et al. | 224/257 |
| 2009/0321490 | A1 * | 12/2009 | Groene et al. | 224/576 |
| 2010/0072334 | A1 * | 3/2010 | Le Gette et al. | 248/176.3 |
| 2010/0108726 | A1 | 5/2010 | Hilgenberg | |
| 2010/0294683 | A1 * | 11/2010 | Mish et al. | 206/320 |
| 2011/0272305 | A1 * | 11/2011 | Lee | 206/320 |

* cited by examiner

APPARATUS AND METHOD FOR STORING AND TRANSPORTING ELECTRONIC DEVICES

PRIORITY CLAIMS

Pursuant to the provisions of 35 U.S.C. §119(e)(1), Applicant claims the priority of: U.S. Provisional Patent Application Ser. No. 61/396,260, filed May 24, 2010; U.S. Provisional Patent Application Ser. No. 61/404,270, filed Aug. 26, 2010; and, U.S. Provisional Patent Application Ser. No. 61/465,555, filed Mar. 19, 2011.

BACKGROUND OF THE INVENTION

1. Field of the Invention

The invention relates generally to improvements in apparatus and methods for storing and transporting portable electronic devices. More particularly, the invention pertains to a portable housing, wearable by the user in a backpack or a sling configuration, including a user accessible opening at one end, providing easy insertion for stowage and removal for use of a portable computer or an electronic tablet.

2. Description of the Prior Art

A number of different arrangements are shown in the prior art for transporting and storing electronic devices, including computers. For example, in U.S. Pat. No. 6,164,505, granted to Holter et al., a Harness For Carrying A Rigid Case is shown. Different constructions for the harness are disclosed, including a backpack releasably attached to a rigid case, upper and lower load straps, shoulder straps, a sternum strap, a diaphragm strap, and a waist strap. However, the rigid case is not adapted to be opened, allowing access to its contents, without removal of the harness and case from the user's upper torso.

U.S. Pat. No. 6,659,319, issued to Purpura, discloses a Laptop Transport And Support System For Mobile Environments. A carrying case is provided, including a base and a hinged cover, the cover being zipper-attached to the base when closed or for transport. Shoulder straps are also provided, to allow the carrying case to be carried as a backpack and to attach to a seat back for support of the case when the laptop is in use.

A Bag With Shoulder Straps And Waist/Hip Support Member is illustrated in Patent Application Publication No. US 2004/0262358, filed by Meyer. The bag, intended to be used for the storage and/or transport of laptop computer, is provided with both a double shoulder strap assembly and a waist/hip support member.

Patent Application Publication No. US 2006/0037987, filed by Lin, discloses a Notebook Computer Suitcase For A User Using As A Desk. The suitcase includes a frame, a cover pivotally mounted to the frame, two belts which extend from respective recoil devices within the frame and have their outer ends attached to the frame, and a position device pivotally attached to the lower side of the frame and adapted to abut the user's abdomen and waist regions. The belts may be used as backpack straps in a transportation mode for the suitcase, and as support straps in a use mode for the computer. In addition, one of the straps may also be used as a carrying strap for transport of the suitcase.

Lastly, in Patent Application Publication No. US 2010/0108726, filed by Hilgenberg, a Computer Backpack is shown. The device includes a portable work station capable of being mounted on a user as a backpack, and converted into a computer workstation while the user is sitting, standing, or walking.

However, the need exists for an apparatus which provides protection from damage to a sensitive electronic device, yet also allows quick and easy insertion and withdrawal of the device without unlatching a cover or a locking mechanism.

The need also exists for an apparatus for storing and transporting an electronic device which can alternatively be fitted with a carrying handle, a sling, or a backpack harness.

The need further exists for an apparatus for storing and transporting an electronic device which includes external structural features adapted to support the device in a plurality of positions for viewing its screen or typing on its keyboard.

These and other objects will become apparent in the specification and the detailed description of the preferred embodiment, to follow.

SUMMARY OF THE INVENTION

Apparatus and methods for storing and transporting electronic devices are disclosed herein. A portable housing includes a base, opposing sides, a movable cover, a closed upper end and an open lower end. The base, the cover, the sides, and the ends of the housing define a storage volume, sized and configured to store a portable electronic device, such as a notebook, a netbook, or an electronic tablet.

The base has a cutout portion at the lower end of the housing. This cutout portion facilitates hand and finger access into the housing for gripping the electronic device during insertion and removal. A slidable door may selectively be deployed to fill the cutout portion, when the base of the housing is placed on an irregular resting surface. A layer of foam or resilient rubber may also be attached over the outer surface of the base, to provide more comfort for the user when the housing is worn as a backpack or in a sling configuration.

The movable cover is generally coextensive with and parallel to the base. The movable cover is resiliently biased into a normally closed position, but has sufficient flexibility so a portion of it can temporarily be lifted away from the underlying portion of the base into an open position. The cover includes an access aperture at the lower end of the housing, so the user's hand and fingers can locate and enter the housing for loading and unloading the electronic device.

Stop means is also provided at the lower end of the housing, extending from the base in the direction of the cover. The stop means partially blocks the opening, and working in conjunction with the resiliently biased movable cover, prevents a stored device from falling out of the lower end of the housing.

The cutout portion in the base and the access aperture in the movable cover, together allow entry of the user's hand and fingers into the housing for either insertion or withdrawal of the device. During either process, the user's hand causes a portion of the movable cover temporarily to be raised into an open position. During insertion of the device, raising the cover allows the device to be slid over the stop means and inserted into the housing until the rear edge of the device clears the stop means. Then, the device is lowered, and the hand and fingers are withdrawn, allowing the movable cover to lower to its normally closed position. When the device is withdrawn, the process is reversed, so the movable cover is temporarily lifted into an open position, the rear edge of the device is lifted to clear the stop means, and the device is pulled clear of the housing. Again, the resiliently biased cover returns to its normally closed position.

A sling, a carrying handle, or a backpack harness may be selectively attached to the housing for transport or storage of the electronic device. Detachable couplers are provided for mating between these carrying fixtures and the housing.

For example, one carrying fixture comprises a hanger body and a sling. One end of the sling is attached to the hanger body, and the other end is attached to one side of the housing at its lower end. The hanger body is detachably coupled to the upper end of the housing through a barb and receiver arrangement.

The carrying handle fixture includes a hand grip, and is attached to the upper end of the housing a pair of detachable barbs identical to those used for the hanger body.

Yet another carrying fixture, the backpack harness, includes straps affixed to a hub which in turn is attached through a pivot mount to the base of the housing.

When the electronic device is removed from the housing for use, the outer surface of the movable cover is provided with outwardly protruding features in the form of a ledge and a lip. These external features support the electronic device in various orientations and angles, for viewing and typing.

DETAILED DESCRIPTION OF THE PREFERRED EMBODIMENT

Figure 1:
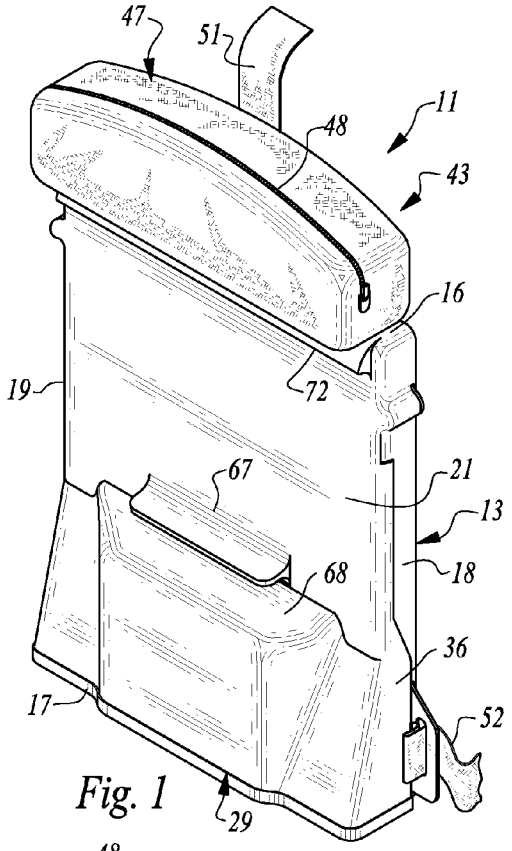
FIG. 1 is a perspective view of the apparatus, showing the movable cover and the hanger body.

Turning now to the drawings, FIG. 1 shows one configuration of the apparatus 11, used for storing and transporting a portable electronic device 12. The electronic device may be a notebook or a netbook computer, or an electronic notepad, such as an I-PAD® or an equivalent device. Typically, these devices tend to be relatively thin and rectangular in configuration, and fragile in nature. To that end, the apparatus 11 includes a housing 13, sized and configured to store an electronic device 12, so that it will be safe from damage in transport, yet quickly and easily removed for use and reinstalled in the housing 13 again for further transport or storage.

Housing 13 includes a base 14, an upper end 16, an open lower end 17, opposing sides 18 and 19, and a movable cover 21, together defining a storage volume 22. It is preferable that housing 13 be manufactured from plastic materials, for ruggedness and protection from the elements. Housing 13 may either be assembled from discrete components, or it may in large part, be injection molded as a unitary structure.

Base 14 extends longitudinally between upper end 16 and lower end 17, and transversely between opposing sides 18 and 19. As is most evident in FIGS. 2 and 3, base 14 preferably includes a centrally positioned cutout portion 23 at the lower end 17. Cutout portion 23 facilitates hand and finger access into the housing 13 for gripping the electronic device 12 during insertion into and removal from the housing. It should be noted that cutout portion 23 may extend entirely through the thickness of the base, as shown, or it may comprise a dished-out recess in the base sufficient to facilitate gripping access to the edge of the electronic device 12.

Figure 2:
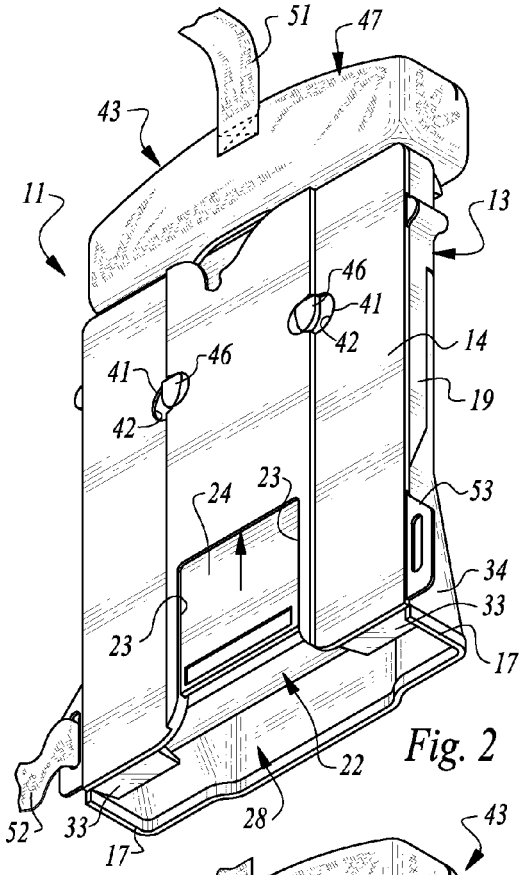
FIG. 2 is a perspective view of the apparatus taken from a low angle, showing the base, the cutout portion, the cover door, and the open lower end of the housing.
Figure 3:
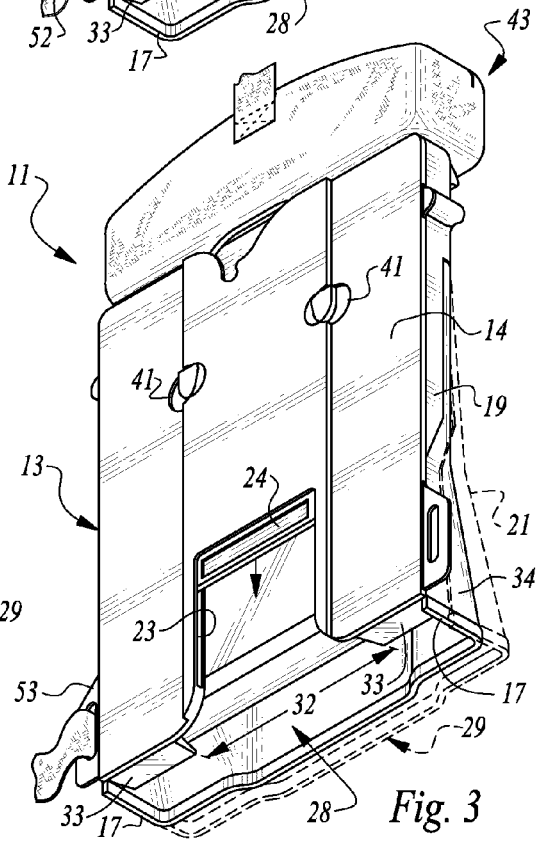
FIG. 3 is a view as in FIG. 2, but showing the movable cover in broken line, in the open position.
Figure 8:
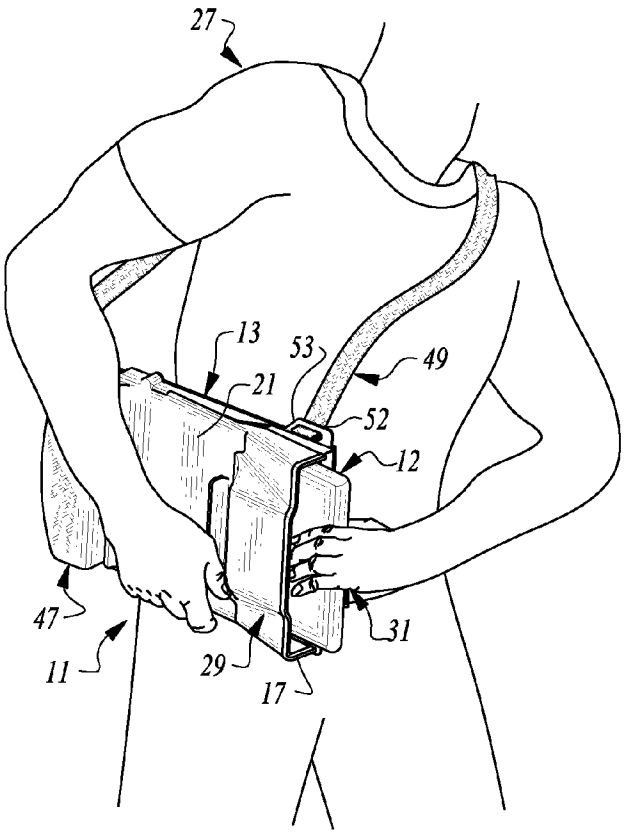
FIG. 8 is a front perspective view, showing the user reaching into the housing to withdraw the electronic device with the other hand securing the housing.
Figure 7:
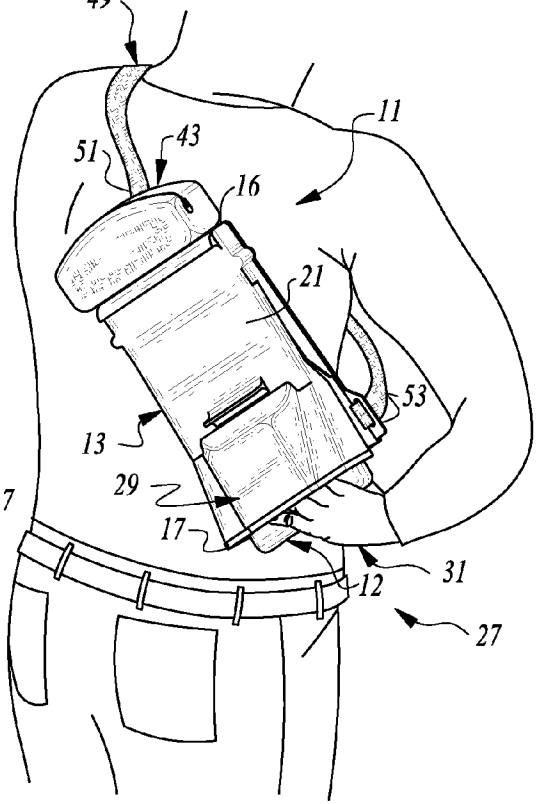
FIG. 7 is a rear perspective view, showing the apparatus with a sling attachment, with the user reaching into the housing to withdraw the electronic device.
Figure 6:
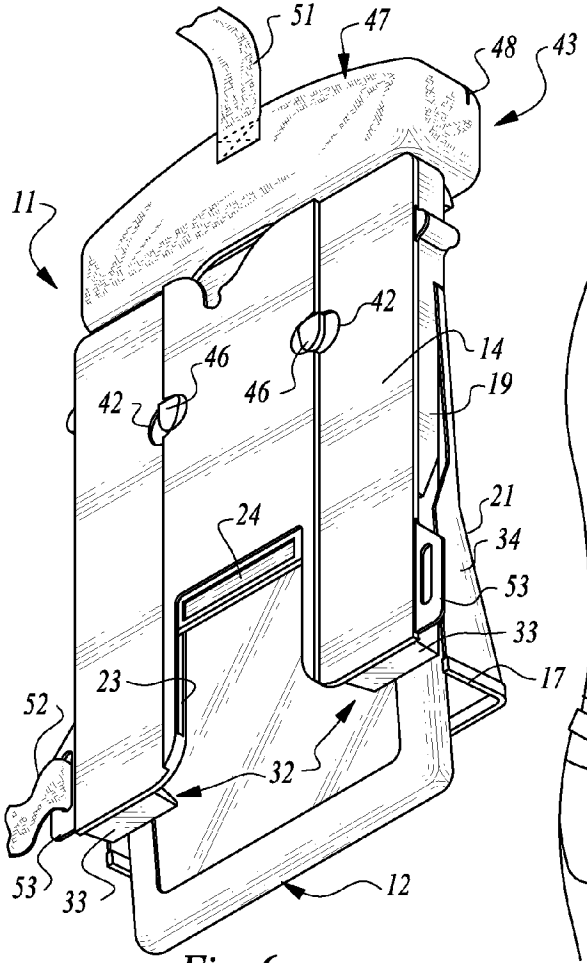
FIG. 6 is a perspective view of the apparatus taken from a low angle, showing an electronic device partly inserted in the open lower end of the housing with the cover in an open position.
Figure 12:
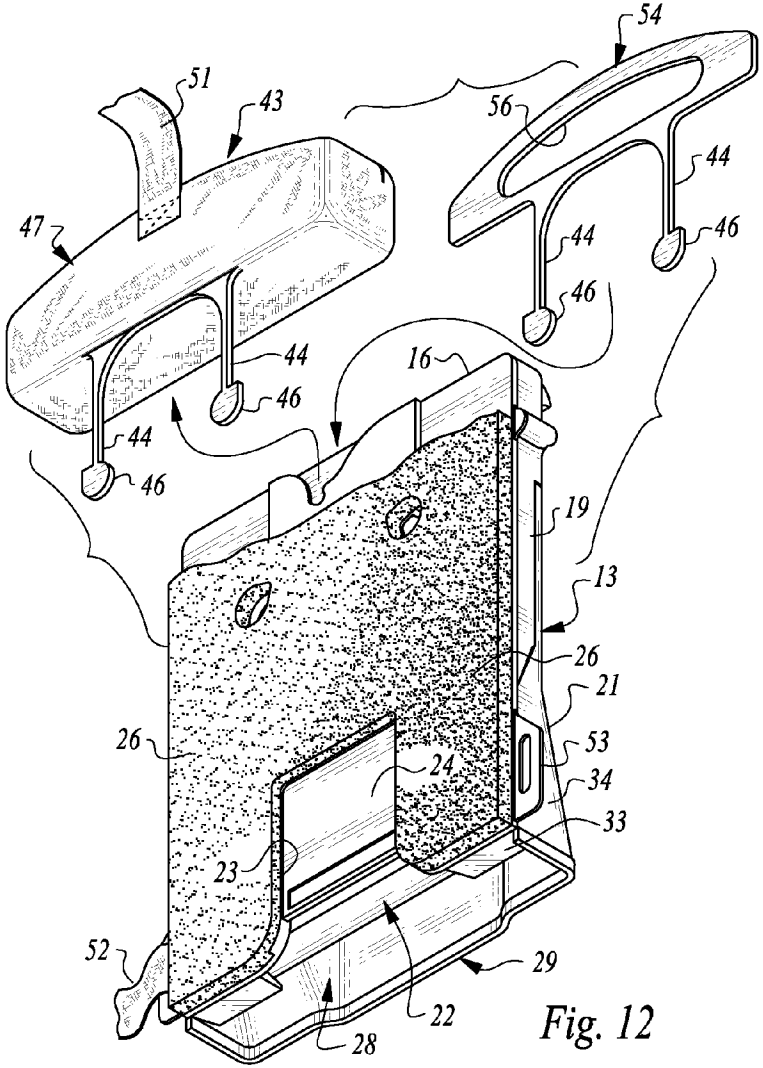
FIG. 12 is a perspective view taken from a low angle, showing the alternative attachments of the hanger body and the carrying handle.

A slidable door 24 is provided within the cutout portion 23, to fill the area of the cutout portion when desired (See, FIG. 2). When so deployed, the door 24 is effective to protect the electronic apparatus 12 from damage, if the base 14 of the housing 13 is placed on an irregular resting surface or during movement of the housing 13. As shown in FIG. 12, layer of foam 26, or resilient rubber, may also be attached over the outer surface of the base 14. The layer of foam 26 will provide more comfort for the user 27, when the housing 13 is worn either as a backpack (FIG. 15) or in a sling configuration (FIGS. 7 and 8).

Figure 4:
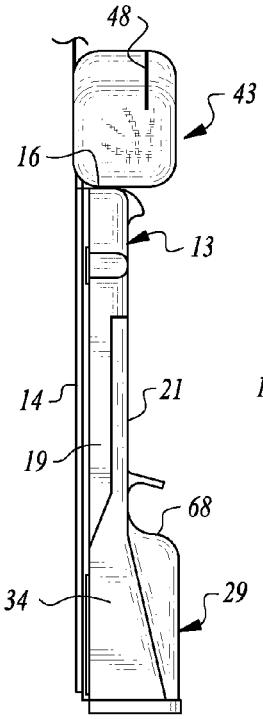
FIG. 4 is a side elevational view, showing the movable cover in a closed position.
Figure 5:
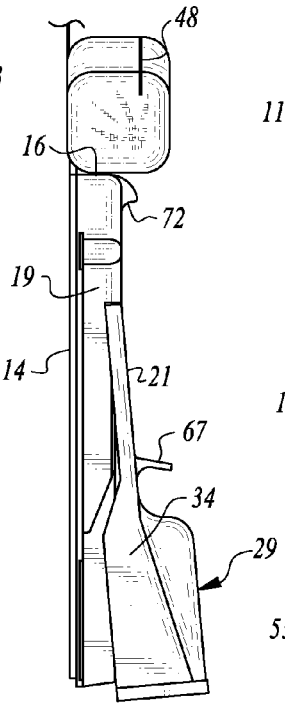
FIG. 5 is a view as in FIG. 4, but showing the movable cover in an open position.
Figure 10:
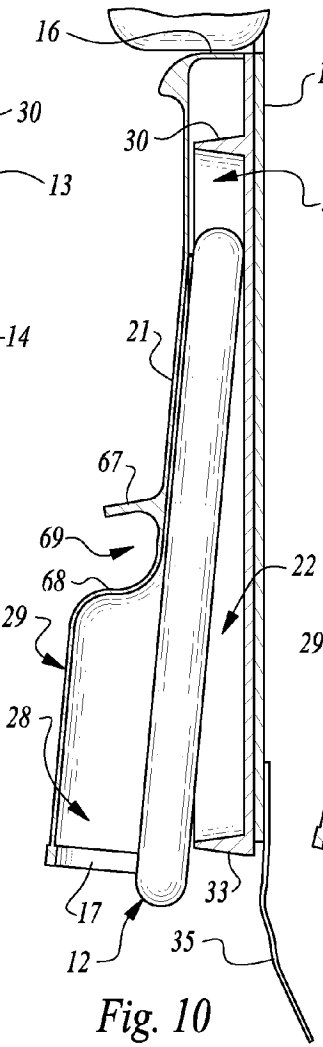
FIG. 10 is a cross-sectional view as in FIG. 9, but showing the movable cover in an open position with the electronic device partially withdrawn.
Figure 9:
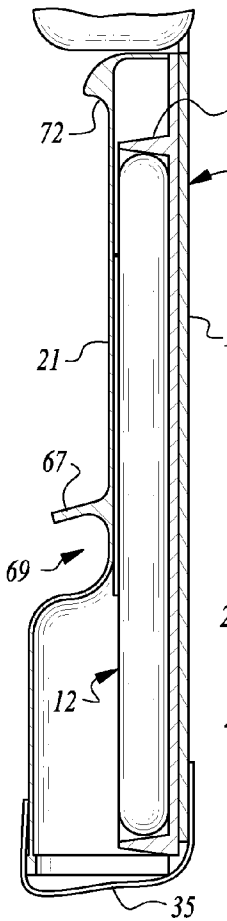
FIG. 9 is a cross-sectional view of the housing with an electronic device therein, and the safety strap in place.
Figure 13:
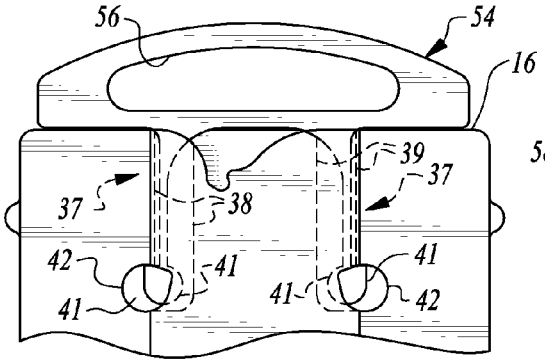
FIG. 13 is a fragmentary elevational view of the upper end of the housing, showing the hanger body locked into place.

Another aspect of housing 13 comprises movable cover 21, generally coextensive in plan with base 14. Owing to its plastic memory, cover 21 is resiliently biased into a normally closed position, shown in FIGS. 1, 2 and 4. In this closed position, cover 21 is in spaced, generally parallel relation to base 14. However, cover 21 also has sufficient flexibility so a portion of it can temporarily be lifted away from the base 14, into an open position. (See, FIGS. 3 and 10). Cover 21 further includes an access aperture 28, at the lower end of the housing 13. Access aperture 28 is defined by an outwardly protruding portion 29 in the cover 21. The general location and size of access aperture 28 corresponds to cutout portion 23 in the base 14. Thus, the aperture 28 and the cutout portion 23 work in conjunction with each other, so the user's hand and fingers 31 can locate and enter the housing 13 for loading and unloading the electronic device 12.

Figure 11:
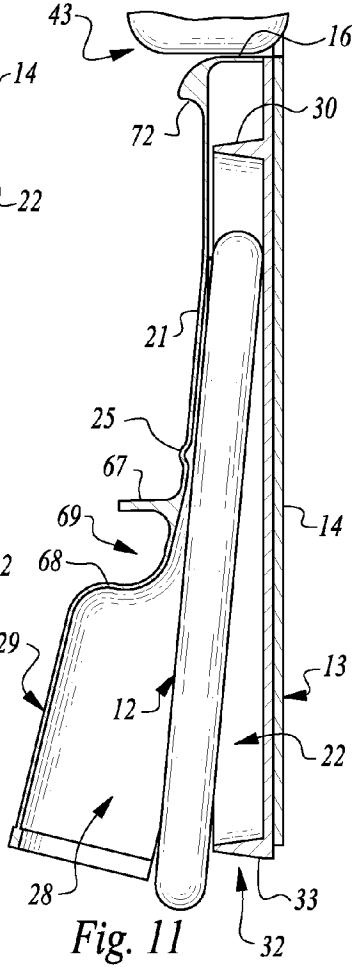
FIG. 11 is a view as in FIG. 10, but showing the additional extent of opening the movable cover, when a plastic hinge is provided across its median portion.

FIG. 11 shows a slight modification to the movable cover 21, that facilitates opening the cover to greater extent with less force. This feature is a plastic hinge 25, extending transversely across the median portion of cover 21. Such plastic hinges are simple to incorporate into a structure, can typically be cycled thousands of times without breaking, yet provide the same functionality as more expensive mechanical hinges.

The housing 13 further includes stop means 32 at its lower end 17, partially blocking the opening therein. Stop means 32 comprises at least one lower bumper 33, located on either or both sides of cutout portion 23. As shown in the drawings, each lower bumper 33 is mounted on an inner surface of base 14, and extends toward movable cover 21. The location and dimensions of the bumpers 33 are such that when cover 21 is biased into a closed position, these features act together to prevent a stored electronic device 12 from falling out of the lower end of the housing 13.

It may also be desirable to include upper bumpers 30 at the upper end of the storage volume 22. These upper bumpers 30 are located so that the distance between them and the lower bumpers 33 is just slightly greater than the overall length of the electronic device 12. In this manner, movement of the device 12 within the housing 13 is restricted.

All or parts of the interior surface of the storage volume 22 may be covered with rubberized or foam material, or other coating, selected to create a high coefficient of friction with respect to the case of the electronic device 12. Such materials or coating will help to minimize movement of the electronic device, particularly when being transported.

Opposing sides 18 and 19 extend from the longitudinal sides of base 14, and complement cover sides 34 and 36 to enclose the sidewalls of the housing 13. Although not critical to the functionality of the movable cover 21, it is desirable to have some portion of cover 21 form the sidewalls of housing 13, to provided greater flexibility and ease of access while loading and unloading electronic device 12.

A detachable safety strap 35 may also be provided across the lower end 17 of housing 13. The safety strap 35 is made from a strip of hook and loop fastener, so it is easily connected to and removed from the protruding portion 29 of the cover 21. The safety strap 35 provides extra assurance to the user 27, by clamping the movable cover 21 in a closed position, thereby keeping the electronic device 12 secured in the housing 13.

For the purpose of transporting or storing the electronic device 12 within the housing 13, detachable carrying fixtures are provided. The upper end 16 of housing 13 has a coupler receiver 37, comprising channels 38 and 39. The lower end of each channel is provided with an enlarged recess 41 and an access hole 42.

Making specific reference to FIG. 12, a hanger body 43 is provided. Hanger body 43 includes a pair of elongated barbs 44, having discs 46 at their lower ends, for detachably mating with coupler receiver 37. To secure hanger body 43 to housing 13, both of the barbs 44 are inserted simultaneously into respective channels 38 and 39. Because the barbs are resiliently biased outwardly away from each other, the discs 46 snap into locking relation within enlarged recesses 41. For removal, access holes 42 are utilized to squeeze the discs slightly together to free them from the recesses, while upwardly pulling on the hanger body 43 to remove the barbs 44 from the housing 13.

Hanger body 43 may also be provided with a fabric or leather storage compartment 47, provided with a zipper 48 for easy loading and removal of personal items and accessories. In one configuration of the apparatus 11, where the housing 13 is to be carried, a sling 49 is provided. One end 51 of the sling 49 is connected to the hanger body 43, and the other end 52 is connected to a strap fitting 53, located on either side of the lower end of the housing 13, to accommodate by left or right-handed users 27. A quick release coupler (not shown) may also be used, to interconnect the end of the sling, with the strap fitting 53. As shown particularly in FIGS. 7 and 8, the sling method for transport of the housing allows the user 27 fast and convenient access both to the housing 13 and to the electronic device 12, for unloading and loading without actually removing the sling 49 or the housing 13.

FIG. 12 illustrates yet another carrying fixture, namely, a handle assembly 54 for use in both carrying and storing the housing 13. Handle assembly 54 includes a pair of barbs 44 fitted with discs 46, identical to those previously described in connection with hanger body 43. And, these barbs and discs work identically in engaging and disengaging with coupler receiver 37 and channels 38 and 39, as described above. Handle assembly 54 also includes an elongated grip aperture 56, sized and configured to be gripped by the palm and fingers of a user 27. In this way, the housing 13 can be carried like a briefcase or a purse, convenient to pick up, transport, and lay down.

Figure 14:
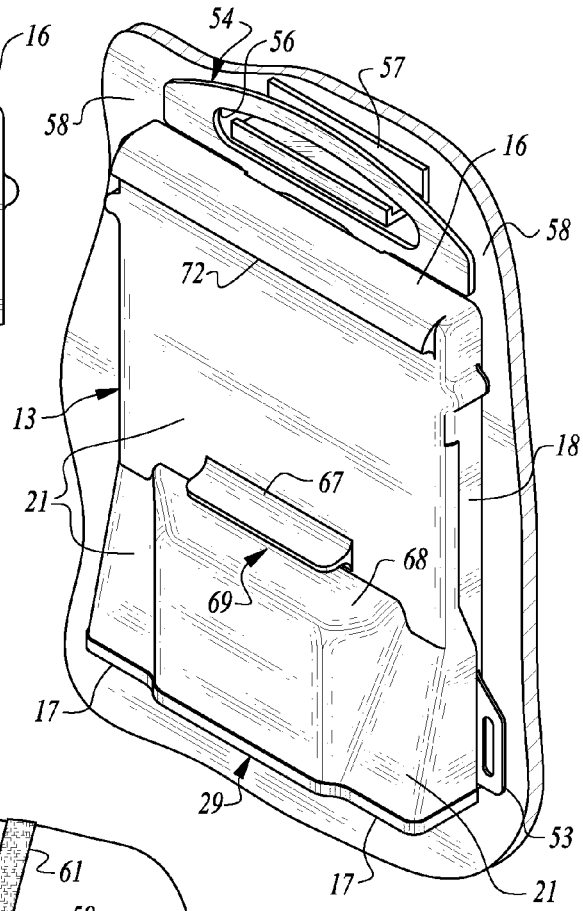
FIG. 14 is a perspective view of the apparatus fitted with the carrying handle, the assembly being supported by a hanging shelf for storage on a wall.

However, handle assembly 54 also has an alternative function, for storage of the housing 13 and the contained electronic device 12. This use is shown in FIG. 14, where a hanging shelf 57 is mounted on a wall 58. The size and configuration of hanging shelf 57 is such that it can be passed through grip aperture 56, for suspending the housing 13 at the desired location and elevation. It should also be noted that battery charging apparatus (not shown) may be strategically located in the same place, for hardwire interconnection or electro-magnetic coupling to the electronic device so the device's battery can be recharged while it is being stored.

Figure 15:
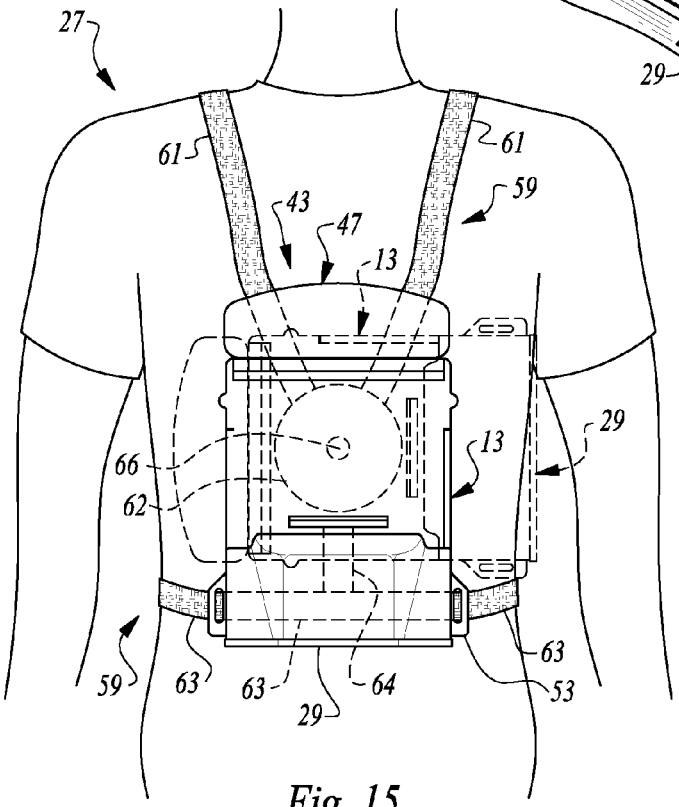
FIG. 15 is a rear view of the apparatus fitted with a backpack harness, the broken line representation showing an alternate rotational position facilitated by the pivotal mount.

Yet another arrangement for carrying the housing 13 is shown in FIG. 15. A backpack harness 59 comprises upper straps 61 having upper ends affixed to a hub 62. Lower straps 63, pass through a hub extension 64, and extend around the user's waist, and are interconnected together around the buckle region (not shown). The upper straps 61 extend to the lower straps 63 in the same buckle region, and are detachably coupled thereto (not shown). In this application, the strap fittings 53 are bypassed, to allow rotation of the housing, discussed below. Many other alternative arrangements exist for harness strapping, and this arrangement is by way of example, only.

The hub 62 is attached to the housing 13 through a pivot mount 66 affixed to the base 14 of the housing 13. A conventional spring-loaded ball and detent mechanism (not shown) may be added to the pivot mount, to allow the housing 13 to be secured in a vertical position for transport. Then, to facilitate access, the housing 13 may be rotated and secured in an alternate horizontal position, shown in broken line in FIG. 15. In the horizontal position, the user 27 will be able to reach into the access aperture 28, for insertion and removal of the electronic device 12, without removing the backpack harness.

Figure 17:
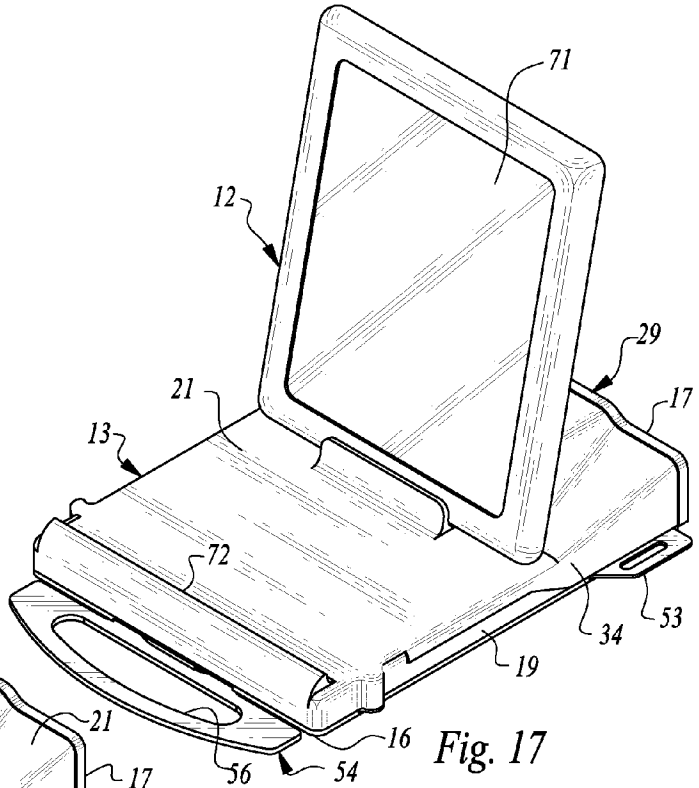
FIG. 17 is a perspective view as in FIG. 16, but showing the electronic device for viewing in a vertical orientation; and, FIG. 18 is a perspective view, showing the electronic device supported on the movable cover in a position for typing.
Figure 16:
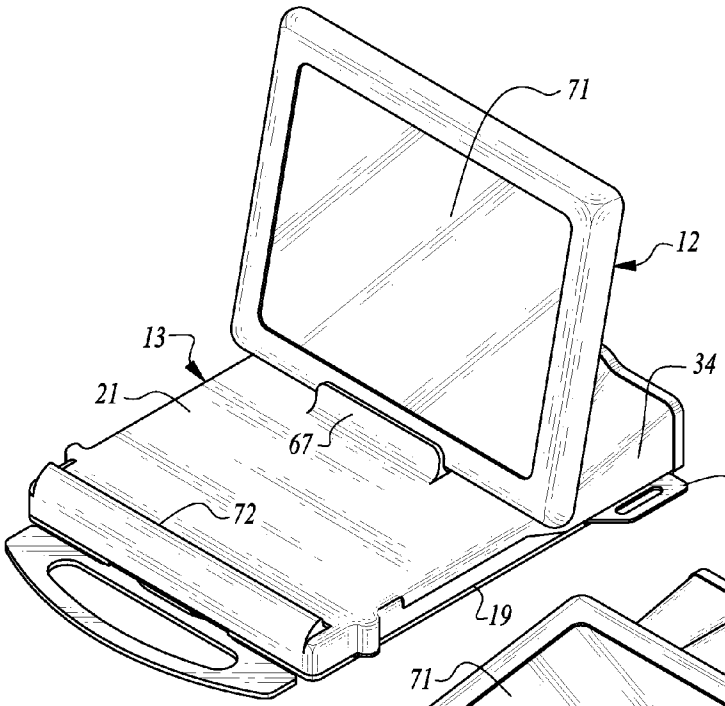
FIG. 16 is a perspective view, showing the electronic device supported on the movable cover, for viewing in a horizontal orientation.

When the electronic device 12 is removed from the housing 13 for use, the outer surface of the movable cover 21 is provided with support features on its outer surface, especially adapted for supporting the electronic device 12 in various orientations and angles, for viewing and typing. The first such feature is an outwardly protruding ledge 67, transversely oriented with respect to the longitudinal axis of cover 21. Protruding portion 29 has an upper face 68 arranged in spaced relation to define an elongated recess 69 for securing an edge of the electronic device 12. The ledge 67 and the face 68 are generally parallel and inclined toward the lower end 17 of the housing 13. FIG. 16 shows the electronic device 12 oriented horizontally, with a lower side edge secured within recess 69. Owing to the orientation of recess 69, the screen 71 of the device 12 is similarly inclined, making viewing pleasurable. FIG. 17 shows the electronic device 12 oriented vertically, with a lower end edge secured within recess 69. For certain types of content, viewing the screen 71 of the device 12 with this orientation may be desirable.

Figure 18:
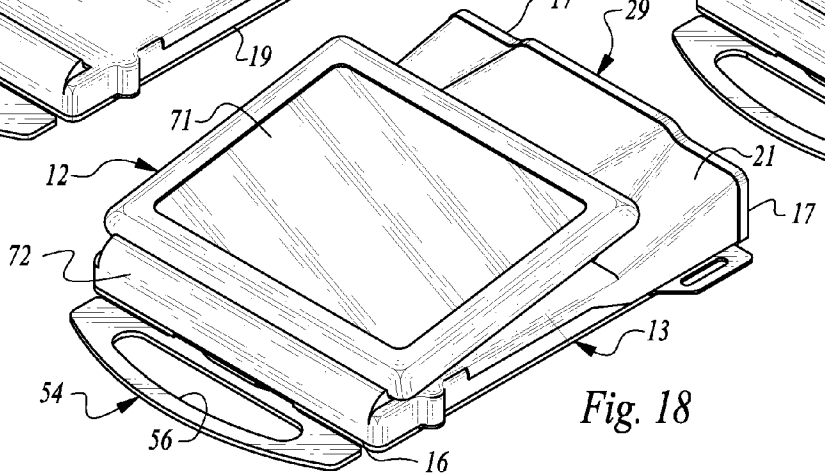

A second support feature comprises an outwardly protruding lip 72, located on the outer surface of the movable cover 21, and extending across the upper end 16 of the housing 13. As shown in FIG. 18, lip 72 is effective to retain a lower side edge of the electronic device 12 when it is oriented in a slightly raised position, extending from the lip 72 to the protruding portion 29 of movable cover 21. In this position, the electronic device 12 is maintained in the proper orientation and inclination for the user 27 to type directly on the screen 71, or the keyboard of the electronic device 12.

It will be appreciated that I have disclosed an apparatus and methods for using same, for securely storing and transporting an electronic device, which apparatus can alternatively be fitted with a sling, a carrying handle, or a backpack harness, and which allows access to its interior storage volume for loading and unloading the electronic device while remaining on the back of the user.

What is claimed is:

1. An apparatus for storing and transporting electronic devices, comprising: a housing having an upper end, an open lower end, and opposing sides defining a storage volume, said housing including a base extending between said upper end and said lower end and between said opposing sides, said base including a cutout portion at said lower end, said housing further including a flexible cover generally coextensive with said base, said cover being resiliently biased into spaced, generally parallel relation to said base in a normal closed position, but movable into an open position by lifting a portion of said cover away from said lower end for loading and unloading an electronic device into and from said housing, said cover further including an access aperture at said lower end, said cutout portion and said access aperture facilitating gripping an end of the electronic device during loading unloading thereof, said housing further including stop means at said lower end, said stop means being sized and configured to allow the electronic device to be loaded and unloaded through the opening at said lower end when said cover is in an open position and partially blocking the opening at said lower end when said cover is in a normal closed position.

2. An apparatus as in claim 1 in which said stop means comprises at least one bumper located on a side of said cutout portion, said at least one bumper being mounted on said base and extending toward said flexible cover but remaining in spaced relation therefrom.

3. An apparatus as in claim 1 in which said housing includes a coupler receiver on said upper end.

4. An apparatus as in claim 3 including a handle assembly, said handle assembly being provided with a coupler for detachably mating with said coupler receiver.

5. An apparatus as in claim 3 including a hanger body, said hanger body being provided with a coupler for detachably mating with said coupler receiver.

6. An apparatus as in claim 5 further including a sling, said sling having one end connected to said hanger body, and the other end connected to said lower end of said housing.

7. An apparatus as in claim 6 in which said hanger body includes a storage compartment.

8. An apparatus as in claim 1 in which said access aperture is formed by an outwardly protruding portion of said flexible cover, said protruding portion having an upper face, and in which an outer surface of said flexible cover includes an outwardly protruding ledge, said upper face and said ledge being arranged in spaced relation to define a recess extending transversely across said outer surface, for securing an edge of the device and maintaining a display screen on the device at a convenient viewing angle.

9. An apparatus as in claim 8 in which said upper face and said ledge are generally parallel and inclined toward said lower end of said housing.

10. An apparatus as in claim 8 further including an outwardly protruding lip on said outer surface of said flexible cover and extending across said upper end of said housing, said lip being effective to retain an edge of the device when oriented in a slightly raised position, extending from said lip to said protruding portion of said movable flexible cover.

11. An apparatus as in claim 1 further including a backpack harness having two straps attached to a hub, said hub being rotatably affixed to the outer surface of said base.

12. An apparatus as in claim 1 including padding generally coextensive with and affixed to an outer surface of said base.

13. An apparatus as in claim 1 in which said base is provided with a slidable door, for selectively exposing and covering said cutout portion.

14. An apparatus for storing and transporting electronic devices, comprising:

a. a housing having an upper end, an open lower end, and opposing sides defining a storage volume, said housing including a base extending between said upper end and said lower end and between said opposing sides, said base including a cutout portion at said lower end, said housing further including a flexible cover generally coextensive with said base, said cover being resiliently biased into spaced, generally parallel relation to said base in a normal closed position, but movable into an open position by lifting a portion of said cover away from said lower end for loading and unloading an electronic device into and from said housing, said cover further including an access aperture at said lower end; and, b. rigid stop means at said lower end partially blocking the opening at said lower end when said cover is in a normal closed position, whereby an electronic device is manually inserted by the user into said apparatus by sliding an end thereof over said stop means to enter said storage volume while lifting said flexible cover into an open position until the other end of the device clears said stop means and the device is lowered onto an inner surface of said base, the hand of the user being withdrawn from the storage volume while said movable cover lowers into a normal closed position and the device is secured.

15. A method for storing and transporting electronic devices, comprising:

a. providing a housing having an upper end, an open lower end, and opposing sides defining a storage volume, said housing including a base extending between said upper end and said lower end and between said opposing sides, said base including a cutout portion at said lower end, said housing further including a movable cover generally coextensive with said base, said cover being resiliently biased into spaced, generally parallel relation to said base, said cover further including an access aperture at said lower end, said housing further including stop means at said lower end partially blocking the opening at said lower end;

b. manually inserting an electronic device into said housing by sliding an end thereof over said stop means to enter said storage volume while lifting said movable cover into an open position until the other end of the device clears said stop means and the device is lowered onto an inner surface of said base, the hand of the user being withdrawn from the storage volume while said movable cover is resiliently biased into a closed position and the device is secured;

c. inserting the hand of the user into said access aperture to raise said movable cover into an open position;

d. grasping the device by a top side and a bottom side, at the lower end thereof;

e. lifting the device until the bottom side is raised above said stop means; and, f. withdrawing the device from the storage volume.

16. A method as in claim 15 including the further step of attaching one end of a sling to said upper end of said housing and the other end of said sling to said lower end of said housing.

17. A method as in claim 15 including the further step of attaching a handle to said upper end of said housing.

18. A method as in claim 15 including the further step of attaching a backpack harness to the outer surface of said base.

19. A method as in claim 18 in which the backpack harness includes a rotatable attachment to said base, allowing said housing to rotate from a normal vertical position for transportation, to a horizontal position for loading and unloading the device from said housing.

* * * * *